US005261336A

United States Patent [19]

Williams

[11] Patent Number: 5,261,336

[45] Date of Patent: Nov. 16, 1993

[54] TANGENTIAL VORTEX FLOW BURNER AND PROCESS

[75] Inventor: Roger B. Williams, Lancaster, Pa.

[73] Assignee: Econo-Energy, Inc., Ephrata, Pa.

[21] Appl. No.: 732,411

[22] Filed: Jul. 18, 1991

[51] Int. Cl.[5] ..... F23D 1/02

[52] U.S. Cl. ..... 110/264; 431/173

[58] Field of Search ..... 110/264, 265, 297; 431/173

[56] References Cited

U.S. PATENT DOCUMENTS 1,932,455 10/1933 Freiday ..... 110/265
2,777,407 1/1957 Schindler ..... 431/173 X
3,039,406 6/1962 Aref ..... 110/264
3,955,512 5/1976 Martin et al. ..... 110/264 X
4,033,505 7/1977 Lutes et al. ..... 110/264 X
4,545,306 10/1985 Wolfram ..... 431/173 X
4,687,436 8/1987 Shigeta ..... 431/173
4,702,181 10/1987 Brown ..... 110/264
4,867,079 9/1989 Shang et al. ..... 110/347 X

*Primary Examiner*—John C. Fox
*Attorney, Agent, or Firm*—William L. Klima

[57] ABSTRACT

A tangential vortex burner and method of burning fuel having a moisture content ranging from 0% to 45%. The burner includes means for the tangential injection of air and fuel at different stages.

18 Claims, 6 Drawing Sheets

FIG. 4
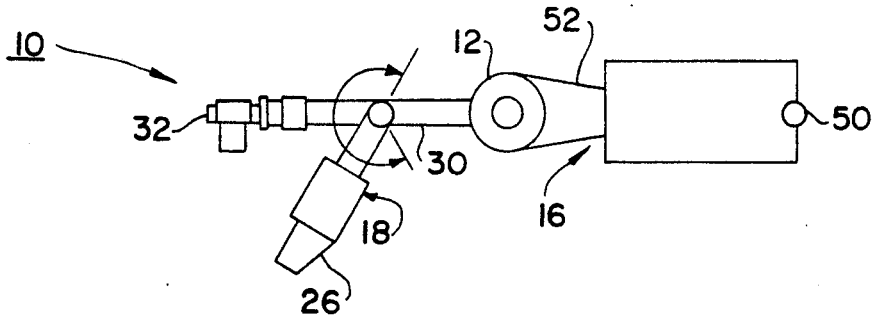
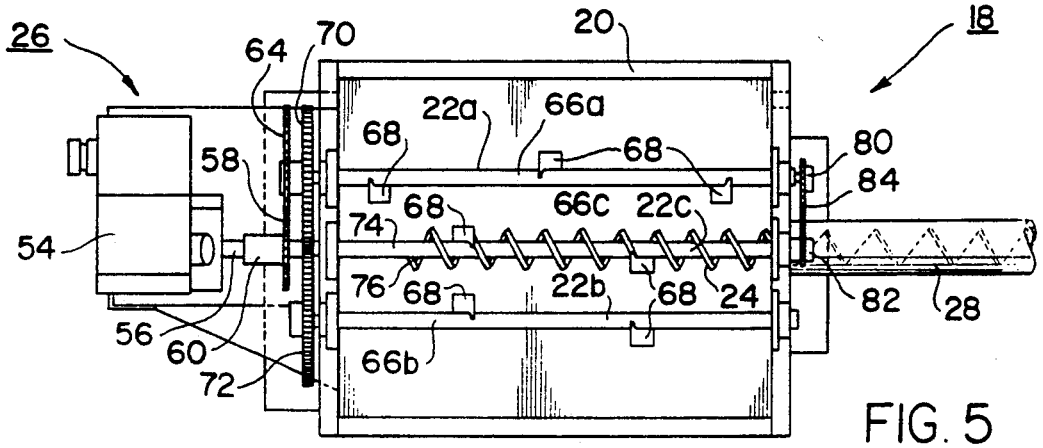
FIG. 5
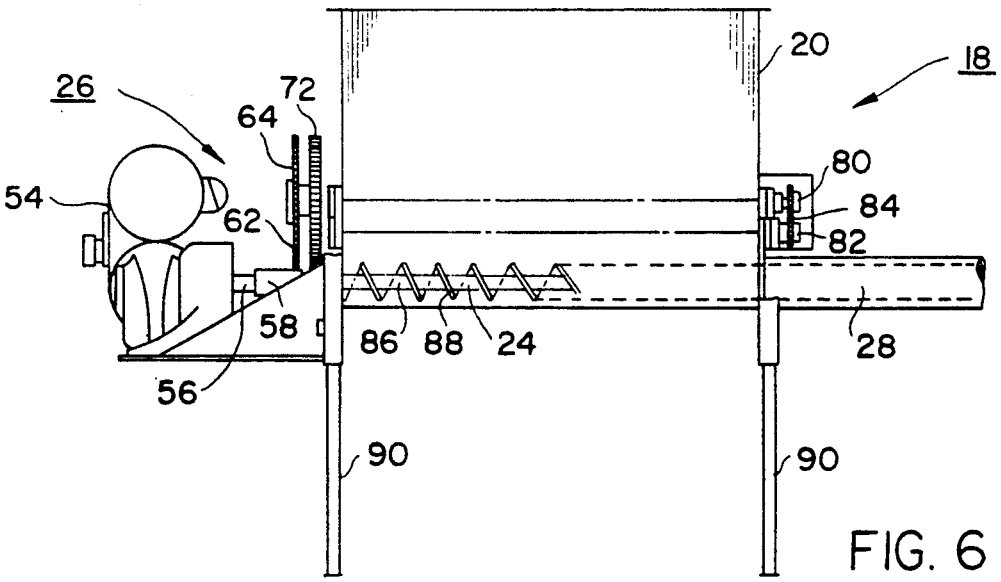
FIG. 6

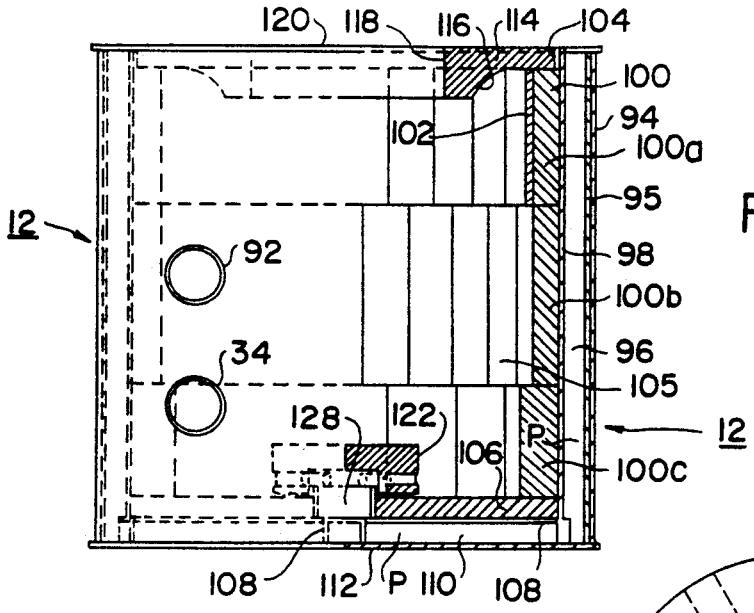
FIG. 10
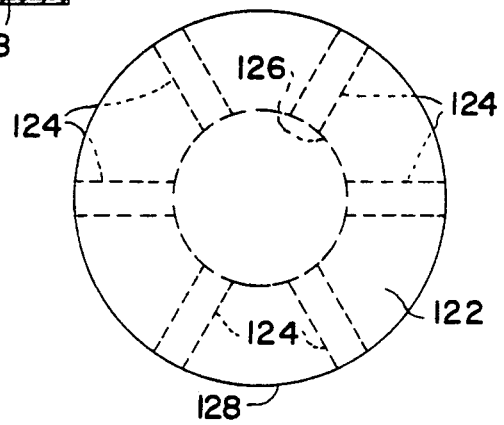
FIG. 11A
FIG. 11B
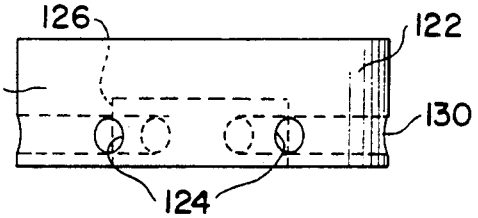
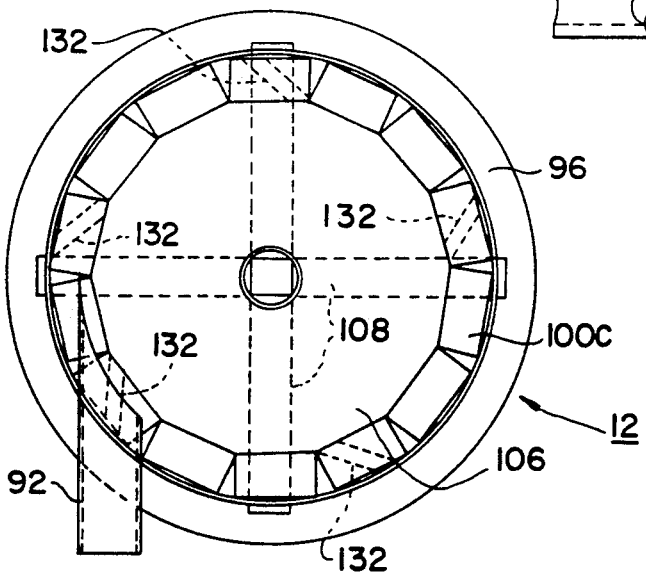
FIG. 12

TANGENTIAL VORTEX FLOW BURNER AND PROCESS

BACKGROUND OF THE INVENTION

1. Field of the Invention

This invention relates to a tangential vortex flow burner configured to form internal tangential vortex flow in the combustion chamber to facilitate efficient and complete combustion of an fuel/air mixture, and a process of burning fuels having a high moisture content. The burner and process according to the present invention is particularly well suited for the incineration of waste products having a relatively high moisture content such as wood chips, hospital waste, rice hulks and other biological waste.

2. Prior Art

There exists numerous types and designs of burners or incinerators presently in use for the production of energy and/or incineration of waste materials. Many old designs use batch type methods of burning separate loads of fuel during operation. However, there exists many examples of continuous fuel supply burners in operation.

There is a need for a burner design that consumes fuel having a high moisture content (0% up to 45% by weight) thoroughly and with good efficiency while producing a minimal amount of polluting waste gas. This need is particularly relevant with respect to the incineration of waste materials having a high moisture content acting as the fuel. For example, wood chips produced in large amounts in the paper and forestry industries have a high moisture and are readily available as an alternative source of fuel.

Wood chips will not burn effectively in conventional incinerators, since wood chips would tend to clog up the inside of an incinerator and not be fully subject to the combustion process causing a material build up in the incinerator. Further, in the application of medical waste disposal it is imperative that the waste be burned at high temperatures and thoroughly to prevent the release of bacteria and virus from the flu gases into the atmosphere causing the possible spread of disease and infection. Typically, medical waste has a high moisture content supplied by tissue remains and used circulatory and lump fluids absorbed into sponge and gauze type bandage materials. Thus, there is a need for the complete incineration of these materials to minimize the chance of the spread of the disease and infection.

SUMMARY OF THE INVENTION

The burner and process according to the present invention have been designed and constructed to ensure the complete combustion and efficient burning of fuel such as waste materials, particular those having a moisture content ranging from 0% to 45% (high moisture content).

The apparatus according to the present invention can include a fuel feeding assembly specifically designed and constructed to feed fuel and/or waste materials with a high moisture content. An embodiment of such an assembly includes a fuel feeding hopper assembly including the combination of a hopper provided with one or more agitators. The agitators are designed and constructed to breaks up lumps of the fuel material such as saw dust and keep it in a fluid state so that it flows downwardly due to the effects of gravity. For example, the agitators can comprise rotating shafts provided with a plurality of mixing paddles.

The hopper can be provided with a screw conveyor at the bottom thereof for feeding the fuel through a feed conduit. The agitators keep the fuel gravity feeding to the screw conveyor to provide a constant supply. A drive assembly comprising gears, chains and sprockets, or other drive components drive the agitators and screw conveyor independently or dependently as desired.

The apparatus can be provided with an air supply system such as a blower assembly. The blower assembly can supply pressurized air through a fuel/air conduit to the main burner assembly. The feed conduit from the fuel feeding hopper assembly connects into the fuel/air conduit to supply fuel thereto. The fuel from the feed conduit mixes with pressurized air supplied to the fuel-/air conduit to provide a pressurized flow of air and fuel to the combustion chamber of the main burner assembly. The flow of fuel/air mixture is introduced into the combustion chamber of the main burner assembly in a tangential manner to form tangential vortex flow in the combustion chamber.

The blower assembly also supplies pressurized air to an air supply conduit extending to one or more plenums in the main burner assembly for the injection of pressurized air at one or more stages to provide tangential vortex flow inside the combustion chamber.

A control system can be provided for controlling the operation of the apparatus. For example, the fuel/air supply conduit and air supply conduit are each provided with a remotely controlled flow valve connected to an actuator. The temperature of the combustion chamber is monitored by a thermocouple to provide an indication signal, which can also be used in the control loop.

The main burner assembly is configured to provide tangential vortex flow in the combustion chamber. For example, the combustion chamber is cylindrical and the fuel/air mixture and additional air is injected into the combustion chamber in a manner to induced tangential vortex flow. This can be accomplished by injecting the fuel/air mixture and other air injection in a tangential manner within the combustion chamber. For example, the injectors have exit ports that are aligned in a tangential direction with respect to the cylindrical configuration of the combustion chamber.

Pressurized air can be tangentially injected into the combustion chamber by a circular manifold positioned in the bottom of the combustion chamber and through tangentially oriented injectors in the sides of the combustion chamber. One embodiment of the present invention achieves four (4) stages of tangential flow injection.

The main burners assembly can be constructed of an outer metal shell (i.e. top, bottom and sides) in a cylindrical configuration. Inside the shell is placed one or more layers of insulation such as fire brick liners. One or more air spaces are defined between the liners and shell to form a general plenum supplied with pressurized air from the blower assembly. The plenum then supplies the pressurized air to the circular manifold and sides of the combustion chamber in a tangential manner to induce tangential vortex flow within the combustion chamber to cause thorough and efficient burning of the fuel.

An exhaust port is provided in the roof of main burner assembly. Additional apparatus can be provided downstream of the exit port such as an external combustion chamber and/or a heat exchanger for boiling water, generating steam, drying air or direct heating. Examples include an external fired Scotch Marine-type fire tube boiler, an external fired high temperature heat exchanger, an external direct fired superheater and an external direct fired dryer. The energy generated by the apparatus can be used for lumber drying kilns, grain dryers, pre-dryers, direct fire dryers, asphalt plants, general food drying, superheaters (steam) and cogeneration systems. The apparatus can deliver temperatures in the range of 500 to 1800 degrees Fahrenheit.

BRIEF DESCRIPTION OF THE DRAWINGS

FIG. 4 is a top view of the burner illustrated in FIG. 3;

FIG. 5 is a top view of a feeder hopper assembly component of the present invention;

FIG. 6 is a side view of the feeder hopper assembly shown in FIG. 5;

FIG. 10 is a side view of the main burner as shown in FIG. 9;

FIG. 11A is a top view of the circular manifold of the main burner assembly;

FIG. 11B is a side view of the circular manifold, shown in FIG. 11A;

FIG. 12 is a top view of the main burner component according to the present invention showing the arrangement of the brick liner;

DETAILED DESCRIPTION OF PREFERRED EMBODIMENTS

Figure 1:
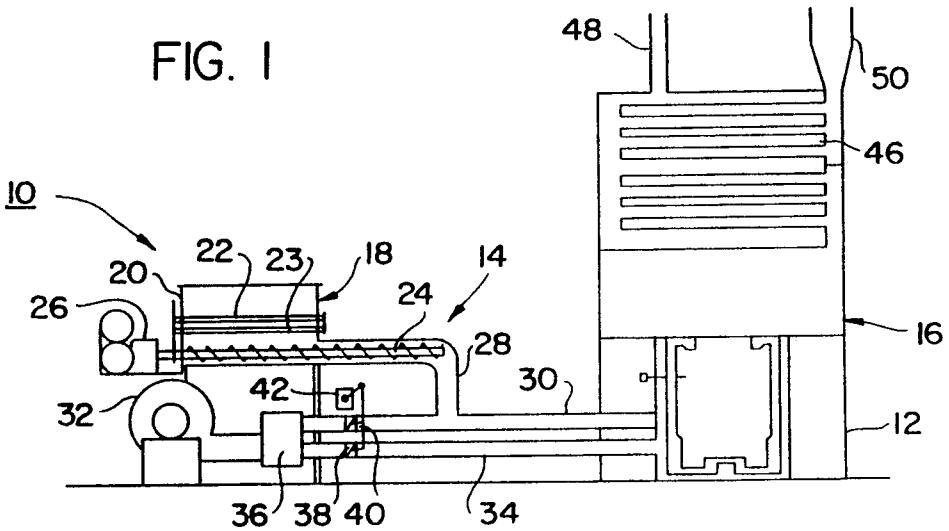
FIG. 1 is a diagrammatical side view of one embodiment of the burner according to the present invention.
Figure 3:
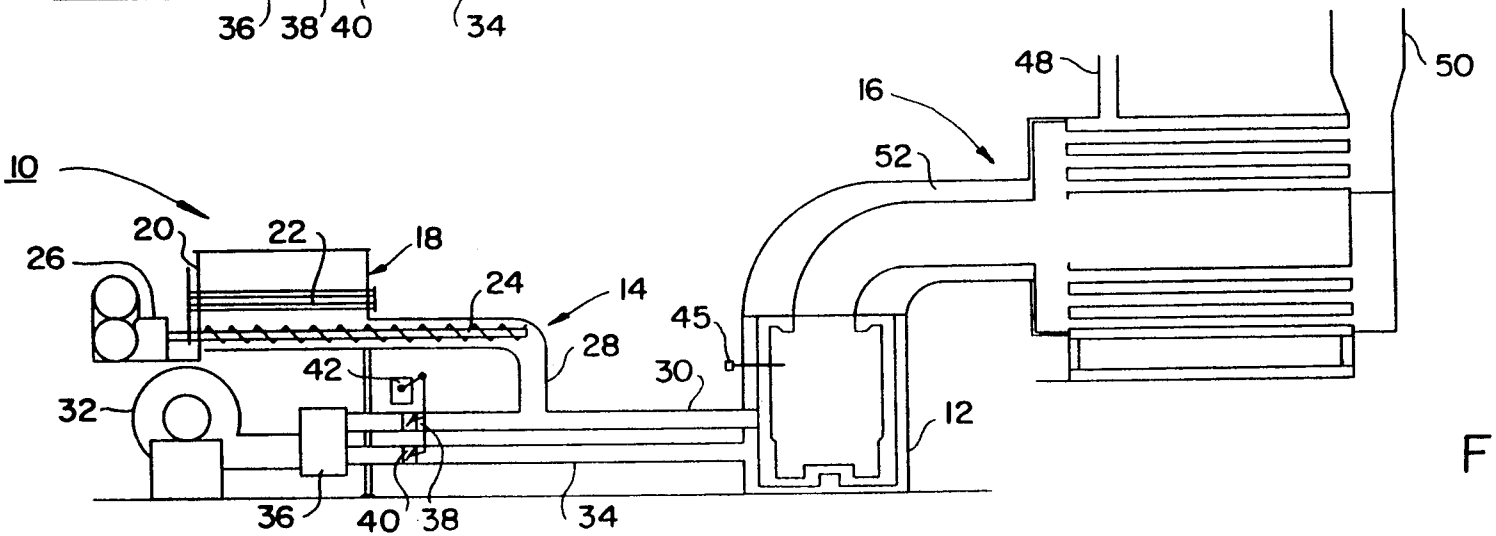
FIG. 3 is a diagrammatical side view of another embodiment of the burner according to the present invention.

A burner 10 according to the present invention is shown in FIGS. 1 and 3. The burner comprises a main burner assembly 12 in combination with a fuel/air feed assembly 14 and an energy extraction assembly 16 such as a steam boiler, hot water boiler or hot air heat exchanger. The energy extraction assembly 16 is slightly different in the embodiments shown in FIGS. 1 and 3.

The feed assembly 14 comprises feed hopper assembly 18 including a hopper 20 provided with agitators 22*a*, 22*b* and 22*c* and a screw conveyor 24. The screw conveyor 24 is driven by drive assembly 26, the details of which will be discussed below.

The screw conveyor 24 includes a conduit section 28 leading to fuel/air supply conduit 30. A blower assembly 32 is connected to the upstream end of fuel/air supply conduit 30. A separate air supply conduit 34 extends between the blower assembly 32 and the main burner assembly 12. A manifold 36 connects the blower assembly 32 to the entrances of air supply conduits 30, 34. A flow valve 38 is provided in fuel/air supply conduit 30 and a flow valve 40 is provided in the air supply conduit 34 for controlling the rate of flow respectively therethrough. The flow valves 38, 40 are operated by a control actuator 44. The control actuator 44 can be controlled remotely for example by a microprocessor control system (not shown). Further, a thermocouple 45 can be provided to sense the temperature inside the combustion chamber of the main burner assembly to provide a signal for monitoring and regulation by the control system.

In the embodiments shown in FIGS. 1 and 3, the energy extraction assembly includes a boiler provided with a series of boiler tubes 46 or other heat conducting means for the conduction of heat from the burner exhaust gases to fluid being circulated therethrough and exiting conduit 48. The burner exhaust gas then exits exhaust 50. In the embodiment shown in FIG. 3, an external burner 52 is provided to further burn the exhaust gases from the main burner assembly 12 to generate additional heat and reduce emissions.

Figure 2:
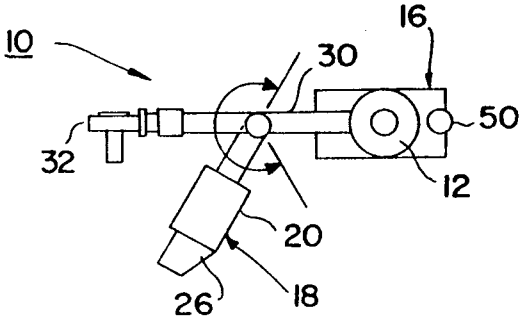
FIG. 2 is a diagrammatical top view of the burner illustrated in FIG. 1.

The burner 10 shown in FIGS. 1 and 3 is configured in a linear arrangement. However, as shown in FIGS. 2 and 4, the overall configuration of the burner 10 can be modified from linear wherein the feed hopper assembly 18 is aligned with the main burner assembly 12, or the feed hopper assembly 18 can be positioned at a variety of angles relative thereto. The angle of the feed hopper assembly 18 relative to the main burner assembly 12 can be set over a wide variance in angle as indicated in FIGS. 2 and 4. This allows substantial flexibility with respect to installation of the burner 10 at various sites, for example, within an industrial building or other installation settings.

Details of the feed hopper assembly 18 are shown in FIGS. 5–8. The feed hopper assembly 18 comprises the hopper 20 with a set of agitators 22*a*, 22*b* and 22*c* rotatably disposed therein. The agitators 22*a*, 22*b* and 22*c* are driven by a drive comprising motor 54 having a drive shaft 56 connected to a sprocket 58 provided on sleeve 60. The sleeve 60 and sprocket 58 combination are keyed onto drive shaft 56. The sprocket 58 drives a sprocket 62 via endless chain 64.

The agitators 22*a* and 22*b* comprise a shaft 66*a* and 66*b*, respectively. The shafts 66*a* and 66*b* are provided with a plurality of mixing paddles 68. One end of one shaft 66*a* is provided with the combination of a sprocket 64 and gear 70 and one end of the shaft 66*b* is provided with a gear 72 intermeshing with gear 70. A third agitator 22*c* comprising a shaft 22*c* and paddles 68 is positioned in the center of the hopper 20, as shown in FIG. 5. The agitator 22*c* is positioned below the agitators 22*a*, 22*b*, and positioned above the screw conveyor 24.

The screw conveyor 24 comprises a shaft 86 provided with a helical blade element 88. The screw conveyor 24 is connected to the motor 54 by shaft 56 and is rotatably driven within the conduit section 28 for conveying fuel such wood chips to the air supply conduit 30.

Figure 7:
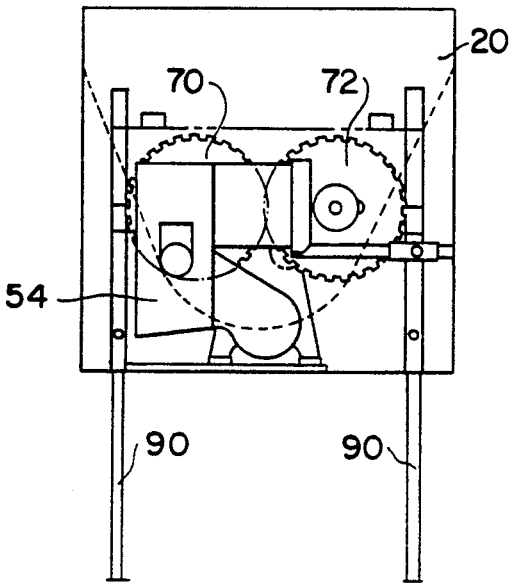
FIG. 7 is a end view of the feeder hopper assembly shown in FIG. 5.
Figure 8:
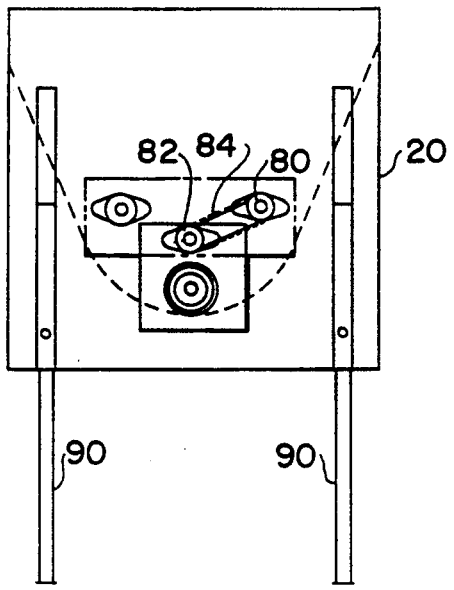
FIG. 8 is an opposite end view of a feeder hopper assembly shown in FIG. 5.
Figure 9:
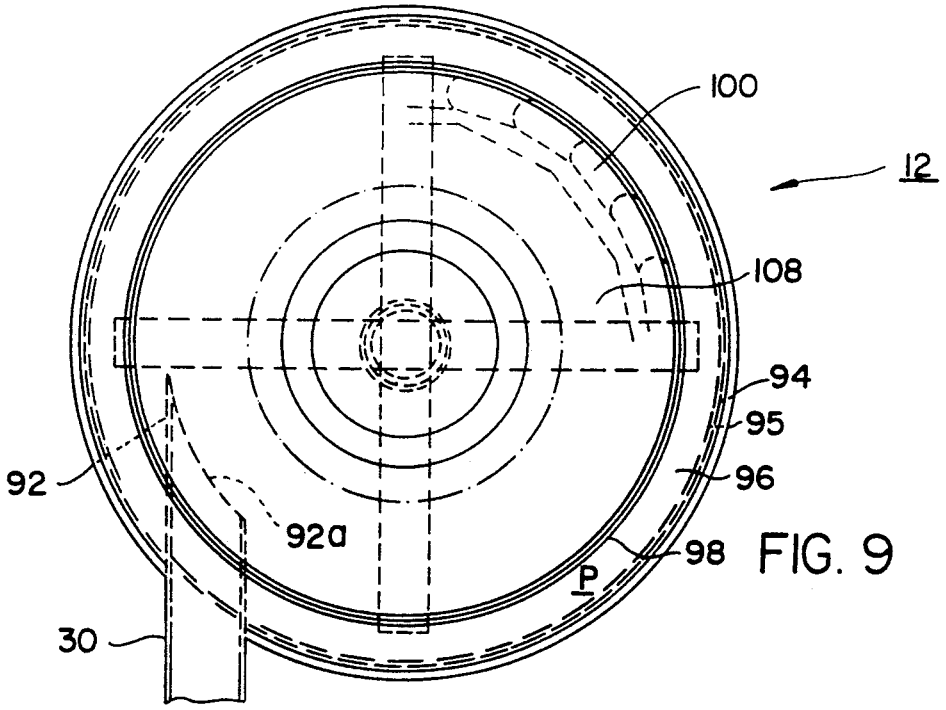
FIG. 9 is a top view of the main burner assembly.

The feed hopper assembly 18 can be supported by various structure such as support legs 90, partially shown in FIGS. 6–8. The support legs 90 support the feed hopper assembly 18 at a sufficient height to allow gravity feeding of the fuel materials in the arrangements shown in FIGS. 1 and 2.

Details of the main burner assembly 12 are shown in FIGS. 9–15. The fuel/air supply conduit 30 includes an end section 92, which passes into the main burner assembly 12. The main burner assembly 12 comprises housing shells 94 and 95, air space 96 (plenum P), inner liner 98, brick liner 100, and brick liner 102. The air supply conduit 34 connects into the main burner assembly 12 in a manner to pressurize an air supply plenum within the main burner assembly 12, as discussed in detail below. A retaining ring 104 is positioned within the inner liner 98 and positioned near the top of the burner for retaining the brick liner 100 in place within the burner.

The end section 92 is provided with a curved end face 92*a*, which is cut flush with the inner surface of the brick insulation layer 102. The end section 92 is positioned so that the fuel/air stream passing through the end section 92 enters the combustion chamber 105 in a tangential manner. The air supply conduit 34 connected through the housing shells 94, 95 to pressurize plenum P.

The housing shells 94 and 95, inner liner 98 and retaining ring 104 can be fabricated, for example, from sheet steel. Further, the brick liners 100 and 102 can be constructed of refractory brick. For example, the brick liner 100 can be made of form fire brick and the brick liner 102 can be made of specially cut form fire brick.

As shown in FIG. 10, the brick liner 100 is constructed of three (3) ring-shaped subcomponent liners 100*a*, 110*b* and 100*c* stacked on top of each other with the lowermost subcomponent liner 110*c* being thicker than the other subcomponent liners 100*a* and 100*b*. The lowermost subcomponent liner 100*c*, for example, can be made of 3"×6"×8½" standard fire brick. The uppermost subcomponent liner 110*a* surrounds the inner brick liner 102. Other combinations of liners and components can be arranged to provide a suitable insulation liner for the main burner assembly 12.

The combustion chamber 105 is partially defined by brick liners 100, 102 and refractory liner 106 made of castable refractory supported on steel channel 108 defining the floor of the combustion chamber 105. An air space 110 is provided by the steel channel 108 positioned between the steel sheet floor 108 and lower housing shell 112. The lower housing shell 112 seals the lower end of the combustion chamber to define the plenum P.

An upper portion of the main burner assembly 12 is provided with a refractory liner 116 having the cross-sectional shape shown in FIG. 10. The refractory liner 116 defines the roof of the combustion chamber 105. The refractory liner 114 includes an inner curved surface 116 to facilitate tangential vortex flow within the combustion chamber 108 and an inner cylindrical surface 118 defining an exhaust for the combustion chamber 108. An upper housing shell 120 is provided for sealing the upper end of the combustion chamber 105 to define the plenum P.

The lower portion of the combustion chamber 105 is provided with a circular manifold 122, as shown in FIGS. 10 and 11. The circular manifold 122 is preferably made of castable refractory. A plurality of air passageways 124 lead from a central plenum 126 to the perimeter 128 of the circular manifold 122. The central plenum 126 supplied with pressurized air from the general plenum P. Further, the air passageways have exit ports extending into a circumferential groove 130.

The air passageways are shown oriented as radially extending from the central plenum 126. However, and possibly more preferably, the air passageways are oriented so that air is injected from the circular manifold in a tangential or near tangential manner into the combustion chamber 105 in a direction to further induce tangential vortex flow therein. For example, the passageways can be formed in the circular manifold by drilling straight holes at an angle relative to the radial direction of the circular manifold (i.e. vector combination of tangential and radial). Alternatively, the air passageways can be curve starting radially outwardly from the central plenum 126 and curving tangentially by the position they exit into the circumferential groove 130.

Figure 13:
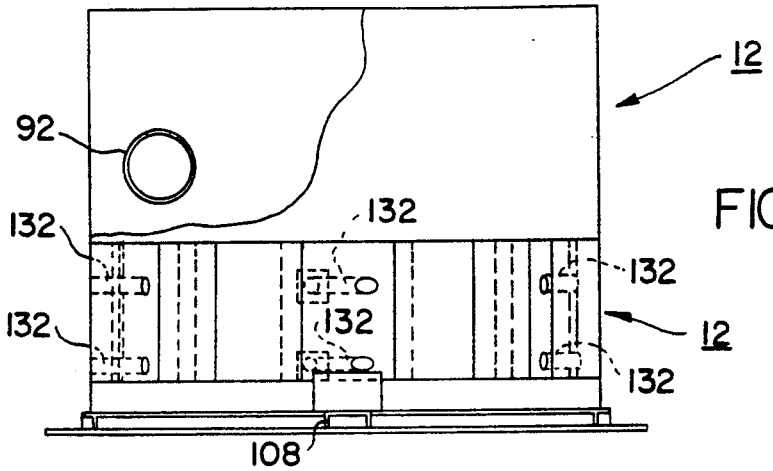
FIG. 13 is a partial side view of the main burner component.
Figure 14:
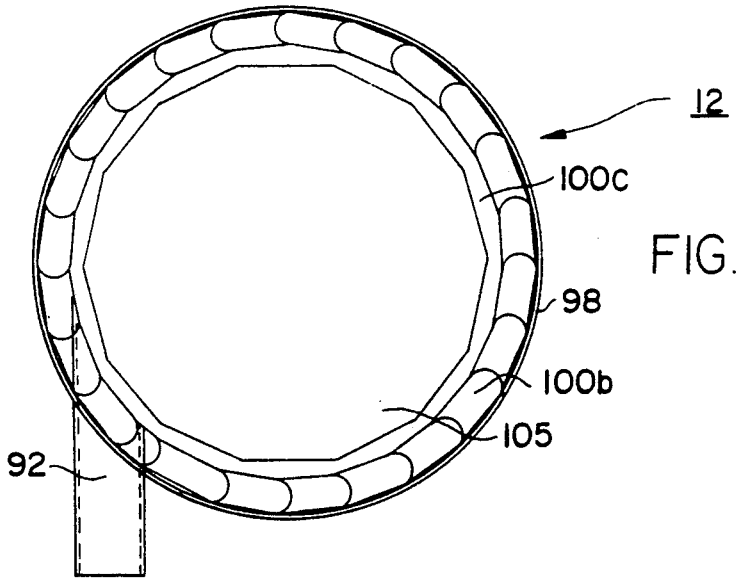
FIG. 14 is a partial top cross-sectional view of the main burner assembly.
Figure 15:
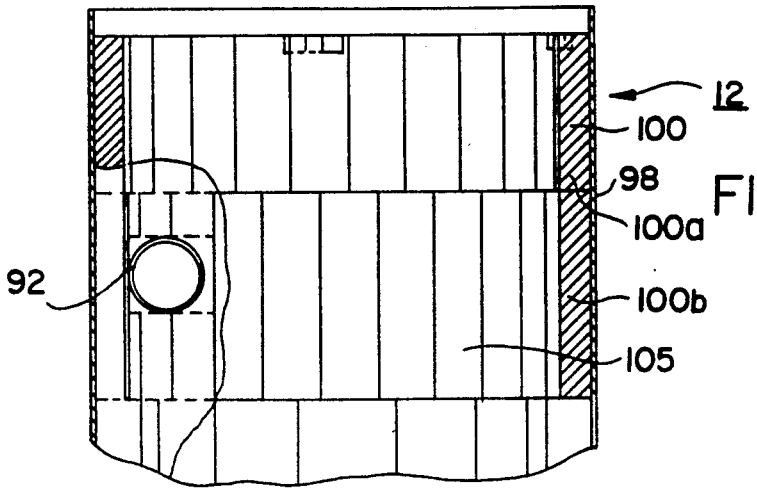
FIG. 15 is a partial vertical cross-sectional view of the main burner assembly according to the present invention.
Figure 16:
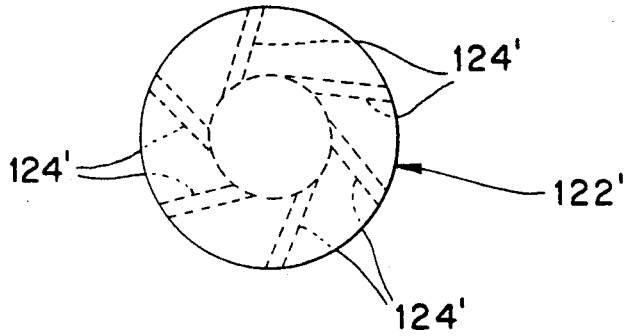
FIG. 16 is a top view of another embodiment of the circular manifold of the main burner assembly.
Figure 17:
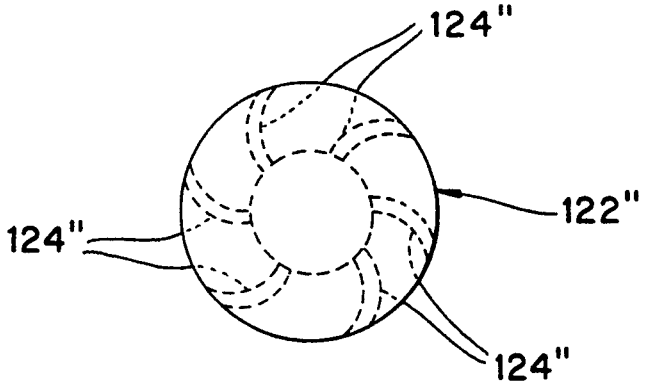
FIG. 17 is a top view of a further embodiment of the circular manifold of the main burner assembly.

Referring to FIGS. 12 and 13, the subcomponent liner 100*c* is provided with air passageways 132 fed with pressurized air through holes (not shown) in the inner liner 98 leading to pressurized air space 96. The air space 96 is confined by housing shells 93, 94, inner liner 98, lower housing shell 112 and upper housing shell 120 to further define the general plenum P. The general plenum P extends under the floor of the combustion chamber 105. However, they can be separate plenums. The air space 96 is supplied with pressurized air from air supply conduit 34. The air passageways 124 are oriented at an angle relative to the radial direction of the circular combustion chamber 105 to induce tangential vortex flow therein. The air passageways 124 are illustrated as being straight, however, they can be curved. Straight air passageways are easy to form by drilling methods through the insulating bricks prior to assembly. See FIGS. 16 and 17.

Air passageways are illustrated only passing through subcomponent liner 100*c*, however, alternatively additional air passageways can be provided through the other subcomponent liners 110*a*, 110*b*, and liner 102.

The apparatus 10 illustrated in the drawing can be defined as having four (4) stages tangential flow induction. The first stage is defined by the tangential injection of the air/fuel mixture through the end section 92 of the fuel/air conduit 30. The second stage is defined by the tangential injection of pressurized air by the circular manifold 122. The third stage is defined by the tangential injection of air through the lower set of fluid passageways 132 through the brick subcomponent liner 100*c*. The forth stage is defined by the tangential injection of air through the upper set of fluid passageways 132 through the brick subcomponent liner 110*c*. It is important to note the positioning of injection within the combustion chamber. The apparatus is such the air is injected at various heights within the combustion chamber and at various radially distances with respect to the cylindrical nature of the combustion chamber 105. For example, the air injected tangentially by circular manifold 126 occurs at a smaller than the air injected though the brick liner subcomponent 100*c*.

The tangential fluid injection of fuel/air or air alone at these various positions within the combustion chamber each has a significant influence on the overall thoroughness and efficiency of combustion of the fuel. Other arrangement can be further selected to accomplished desire heat generation and emission results.

OPERATION

The operation of the apparatus 10 according to the present invention is as follows. Fuel such as saw dust is loaded into the hopper 20 of the feed hopper assembly 18 as needed. The drive assembly 26 operates the agitators 22a, 22b and 22c to break up the saw dust and keep it flowing to the screw conveyor 24 with the aid of gravity feeding.

The screw conveyor 24 moves the saw dust along the conduit section 28 till it reaches the fuel/air conduit 30. Pressurized air is supplied to the fuel/air conduit 30 by blower assembly 32. The air stream mixes with the saw dust dropping into the fuel/air conduit 30 from conduit section 28 to form a flowing mixture thereof to be injected tangentially into the combustion chamber 105 via end section 92.

An additional stream of air is supplied via air supply conduit 34 to the plenum P defined by air space 96 and 110 for providing pressurized air for tangential injection through the air passageways 132 of the brick liner 110c and air passageways 132 of the circular manifold 122.

The flow of air through conduits 30 and 34 are controlled by flow valves 38 and 40, respectively, and control actuator 44. The control actuator 44 is controlled by a central control system such as a microprocessor control system, or other means of control. Thermocouple 45 senses the temperature in the combustion chamber 105, which provides a signal to the control system.

The fuel and air tangentially injected inside the combustion chamber form a turbulent mixing tangential vortex flow therein thoroughly and efficiently burning the fuel. The exhaust gases exit through the exhaust opening in the roof of the combustion chamber. The heat from the process is subsequently recovered by various heat exchangers and methods. Alternatively, the main burner assembly can be fitted with an external burner to further burn the exhaust to provide additional heat and reduce emissions.

I claim:

1. A tangential flow burner with vortex air flow therein, comprising:

a fuel supply;

a main burner assembly configured in a substantially vertical flow arrangement, said main burner assembly having a combustion chamber configured for supporting tangential vertical flow therein, said combustion chamber having a substantially cylindrical configuration;

a conduit connecting said fuel supply to said main burner assembly for injecting a fuel/air mixture tangentially into said combustion chamber in a direction of the vortex air flow;

an air injector supplied with pressurized air for tangentially injecting air into said combustion chamber in the direction of the vortex air flow, said air injector configured to introduce one or more streams of air to induce tangential flow at different diameter positions within said housing, said air injector including a circular manifold positioned in a lower portion of said combustion chamber for providing air flow in an outward direction between said circular manifold and said cylindrical combustion chamber above a floor of said combustion chamber; and an exhaust fluidly connected to said combustion chamber for exhausting combusted gases from the burner.

2. A burner according to claim 1, wherein said air injector and said conduit supply the injection of air at different stages within said combustion chamber.

3. A burner according to claim 2, wherein said conduit includes a downstream end passing through a housing of said main burner assembly and oriented tangentially with respect to said combustion chamber.

4. A burner according to claim 3, wherein an end of said conduit is provided with a curved end surface oriented with the direction of tangential vortex flow within said housing.

5. A burner according to claim 3, wherein an upstream end of said conduit is connected to an air supply with said fuel supply connecting into said conduit at a position downstream relative to said air supply.

6. A burner according to claim 5, wherein said air supply is provided by a blower connected to the upstream end of said conduit.

7. A burner according to claim 3, wherein said fuel supply comprises a hopper connected to a screw conveyor connected into said conduit.

8. A burner according to claim 7, wherein said hopper is provided with an agitator.

9. A burner according to claim 8, wherein said agitator comprises at least one rotating shaft provided with elements for agitating the fuel within said hopper.

10. A burner according to claim 2, wherein said air injector provides tangential flow at multiple stages within said combustion chamber.

11. A burner according to claim 1, wherein an air/fuel mixture is introduced tangentially within said combustion chamber and a separate air flow is introduced tangentially at a different position within said combustion chamber.

12. A burner according to claim 11, wherein said conduit connects to an air supply and said fuel supply to introduce an air/fuel mixture tangentially within said combustion camber and a second conduit connects to an air supply and introduces a tangential air flow within said combustion chamber.

13. A burner according to claim 1, wherein said circular manifold is defined by a central plenum having a plurality of air passageways leading from said central plenum to corresponding exit ports positioned about the perimeter of said circular manifold.

14. A burner according to claim 13, wherein said air passageways are radially extending.

15. A burner according to claim 13, wherein said air passageways are oriented so that air is injected from said circular manifold in a tangential or near tangential manner into said combustion chamber to further induce vortex flow.

16. A burner according to claim 15, wherein said passageways through said circular manifold are straight and set an angle.

17. A burner according to claim 15, wherein said passageways through said circular manifold are curved.

18. A tangential flow burner with vortex air flow therein, comprising:

a fuel supply;

a main burner assembly configured in a substantially vertical flow arrangement, said main burner assembly having a combustion chamber configured for supporting tangential vertical flow therein, said combustion chamber defined by a floor extending to a cylindrical wall construction with an opening at a top thereof;

a conduit connecting said fuel supply to said main burner assembly for injecting a fuel/air mixture tangentially into said combustion chamber in a direction of the vortex air flow;

an air injector supplied with pressurized air for tangentially injecting air into said combustion chamber in the direction of the vortex air flow, said air injector configured to introduce one or more streams of air to induce tangential flow at different diameter positions within said housing, said air injector including a circular manifold positioned in a lower portion of said combustion chamber and extending upwardly from said floor of said combustion chamber for providing air flow in an outward direction between said circular manifold and said cylindrical combustion chamber along a circular floor portion extending therebetween; and an exhaust connected to said combustion chamber at said opening for exhausting combusted gases from the burner.

* * * * *